US005495990A

United States Patent [19]

Tamura et al.

[11] Patent Number: 5,495,990

[45] Date of Patent: Mar. 5, 1996

[54] METHOD AND APPARATUS FOR REMOVING WRAPPED YARN GROUP ON PACKAGE BOBBIN END

[75] Inventors: Masayuki Tamura, Matsuyama; Akira Shinohara, Ehime; Koichi Kobayashi, Mihara; Yasushi Maekawa; Minoru Yoshida, both of Matsuyama, all of Japan

[73] Assignee: Teijin Limited, Osaka, Japan

[21] Appl. No.: 36,667

[22] Filed: Mar. 25, 1993

[30] Foreign Application Priority Data

| | | | |
|---|---|---|---|
| Mar. 25, 1992 | [JP] | Japan | 4-067121 |
| Jun. 5, 1992 | [JP] | Japan | 4-145656 |
| Aug. 14, 1992 | [JP] | Japan | 4-216854 |
| Oct. 29, 1992 | [JP] | Japan | 4-291464 |

[51] Int. Cl.[6] ..... B65H 54/00; B65H 54/02; B65H 69/04; B65H 75/32

[52] U.S. Cl. ..... 242/18 R; 242/35.6 E; 242/36; 242/35.50 A; 242/19; 242/18 EW; 57/306

[58] Field of Search ..... 242/18 R, 19, 242/27.1, 35.6 E, 46.6, 18 G, 18 PW, 18 EW, 355 A, 49, 36, 28, 571.5, 46.4, 125.1; 57/303, 305, 306

[56] References Cited

U.S. PATENT DOCUMENTS

| | | | |
|---|---|---|---|
| 3,999,721 | 12/1976 | DuFresne | 242/571.5 X |
| 4,085,901 | 4/1978 | Sanders | 242/18 G |
| 4,158,444 | 6/1979 | Krauss | 242/19 X |
| 4,324,368 | 4/1982 | Inouye et al. | 242/18 PW |
| 4,436,249 | 3/1984 | Santa Lucia et al. | 242/18 R |
| 4,760,969 | 8/1988 | Otoshima et al. | 242/35.6 E X |
| 4,995,562 | 2/1991 | Koga et al. | 242/35.6 E |
| 5,005,776 | 4/1991 | Schwarz | 242/19 X |
| 5,253,817 | 10/1993 | Hatakeyama et al. | 242/18 R |
| 5,356,085 | 10/1994 | Kobayashi et al. | 242/35.6 E X |

FOREIGN PATENT DOCUMENTS

| | | | |
|---|---|---|---|
| 23077477 | 11/1976 | France . | |
| 7308019 | 6/1973 | Germany . | |
| 4030658 | 4/1991 | Germany | 242/19 |
| 4119039 | 12/1991 | Germany . | |
| 57-036233 | 8/1982 | Japan . | |
| 58-119553 | 7/1983 | Japan . | |
| 60-012570 | 1/1985 | Japan . | |
| 61-140473 | 6/1986 | Japan . | |
| 64-14337 | 1/1989 | Japan . | |
| 1-20368 | 6/1989 | Japan . | |
| 1226668 | 9/1989 | Japan . | |
| 1321264 | 12/1989 | Japan . | |
| 2043180 | 2/1990 | Japan . | |
| 6-191733 | 7/1994 | Japan . | |

*Primary Examiner*—Daniel P. Stodola
*Assistant Examiner*—Michael R. Mansen
*Attorney, Agent, or Firm*—Burgess, Ryan & Wayne

[57] ABSTRACT

A method for removing a wrapped yarn coil of an initial yarn portion of a package; the wrapped yarn coil being wound on a bobbin while being gripped by a slit-like groove formed on the bobbin end along a peripheral circle of the bobbin, and being followed by a transfer tail; including steps of severing the wrapped yarn coil at a position on the bobbin end in which the slit-like groove does not exist, while holding the severed ends of the wrapped yarn coil by suction, gripping the severed ends by grippers, and removing the wrapped yarn coil from the slit-like groove along the periphery of the bobbin while rotating the grippers in the twisting direction so that a twist is imparted to the wrapped yarn coil held by the grippers.

18 Claims, 11 Drawing Sheets

METHOD AND APPARATUS FOR REMOVING WRAPPED YARN GROUP ON PACKAGE BOBBIN END

BACKGROUND OF THE INVENTION

1. Field of the Invention

The present invention relates to a treatment of a wrapped yarn coil wound on a bobbin end of a package formed by a yarn take-up machine, particularly to a method and apparatus for peeling off and removing a wrapped yarn coil of synthetic yarn for forming a transfer tail when a paper tube is used as a bobbin, and a conveyor line for effectively carrying out such operation.

2. Description of the Related Arts

Recently, when a synthetic yarn such as of polyamide fibers or polyester fibers is treated by a draw twister or a draw texturing machine, a transfer tail is formed on a bobbin of packages produced by a melt-spinning process, for connecting a trailing end of a preceding package with a beginning end of a subsequent package so that a continuous processing is possible. The transfer tail is formed at the initial stage of the package formation by winding a pig bunch (pig tail) on a bobbin end portion outside of a traverse range (see, for example, Japanese Examined Patent Publication No. 57-36233 and Unexamined Patent Publication No. 58-119553).

After the package is doffed from the take-up machine, the pig bunch is peeled off and a predetermined length of yarn is left on the bobbin end to form a true transfer tail. A free end of the transfer tail is fixed on the bobbin end by a tape, label or seal (see, for example, Japanese Unexamined Patent Publication Nos. 1-226668 and 1-321264).

In the prior art, such a pig bunch treating operation is manually carried out, and has drawbacks in that much man power and time are necessary, the products may be contaminated and the quality of the transfer tail may fluctuate.

To solve the above problems, there are many proposals for automating this process in that the pig bunch is scratched off by a scratch band provided on a robot, or peeled off in the peripheral direction of the bobbin after being melted by an electric heater, as disclosed in Japanese Unexamined Patent Publication Nos. 60-12570 and 2-43180.

However, these processes have been unsatisfactory.

Bobbins provided with a slit on a bobbin end for easily catching a yarn end have been widely used. Corresponding to the recent tendency to increase automatic yarn winders, the slit has a saw-tooth like configuration to enhance a yarn catching ability.

According to this type slit, since the yarn is fitted and caught into the saw-teeth, the yarn gripping force increases, for example, from 200 g to 1500 g. Therefore, the yarn portion caught by the slit is hard to remove manually or even mechanically. Even though the yarn body is removed, a broken end may be left in the slit and interfere with a package yarn when it is unwound from this package.

In addition, if the broken yarn end is left in a slit (even of a usual type), the yarn catching operation may fail when the bobbin is reused, due to the lowering of yarn gripping force.

SUMMARY OF THE INVENTION

It is an object of the present invention to solve the above problems of the prior art and provide a method and apparatus for quickly and assuredly removing a wrapped yarn coil (a pig bunch yarn) from a yarn catching slit without residue. It is another object of the present invention to provide method and apparatus for quickly and assuredly removing pig bunch yarns of various thicknesses without changing any conditions.

It is further object of the present invention to improve an operational efficiency by positioning and rotating the package while it is carried on a tray and not transferred to an automatic package treating apparatus but and, so that the loads on the automatic treating apparatus are reduced, resulting in the reduction of treatment time and the improvement of package quality due to the reduced frequency of loading/unloading operations. It is still a further object of the present invention to provide, for the purpose of automatic peel-off operation of the wrapped yarn coil and the pig tail yarn, a method for detecting a slit-like groove formed on an area of a bobbin end along a peripheral circle thereof or another groove or recess for the positional detection and determining a yarn severing position in the peripheral direction. It is a further object of the present invention to assuredly detect positions of a wrapped yarn coil and a pig tail yarn along the bobbin axis and to sever the same and fix the severed end by a seal so that a transfer tail end is formed.

It is a further object of the present invention to solve problems of enlargement of installation space due to the increase in number of packages handled as well as the lowering of the transportation efficiency.

The above objects are achieved by the following methods and apparatus according to the present invention.

A method is provided for removing a wrapped yarn coil of an initial yarn portion of a package, the wrapped yarn coil being wound on a bobbin while being gripped by a slit-like groove formed on the bobbin end along a peripheral circle of the bobbin, and being followed by a transfer tail, comprising steps of severing the wrapped yarn coil at a position on the bobbin end in which the slit-like groove does not exist, while holding the severed ends of the wrapped yarn coil by suction, gripping the severed ends by grippers, and removing the wrapped yarn coil from the slit-like groove along the periphery of the bobbin while rotating the grippers in the twisting direction so that a twist is imparted to the wrapped yarn coil held by the grippers.

An apparatus is provided for removing a wrapped yarn coil of an initial yarn portion of a package arranged on the lateral side of a conveyor for transporting a tray carrying a package, the wrapped yarn coil being wound on a bobbin while being gripped by a slit-like groove formed on the bobbin end along a peripheral circle of the bobbin, and being followed by a transfer tail. The apparatus comprises a cutting means for severing the wrapped yarn coil; a pair of yarn suction means for holding the severed end of the wrapped yarn coil by suction; a seal delivery means for fixing an end of the transfer tail to the bobbin end by adhering a seal on the end of the transfer tail by a seal holding device movable upward/downward and/or forward/backward; and a pair of yarn gripping means for gripping the severed end of the wrapped yarn coil. The yarn suction means is arranged on the left and right sides of the bobbin end confronting each other; the yarn gripping means comprises a gripper consisting of a pair of movable elements associated with each other to occupy open and closed positions and a driving device for rotating the gripper, and is connected to means movable forward/backward and/or upward/downward.

A method is provided for removing a wrapped yarn coil of an initial yarn portion of a package, the wrapped yarn coil being wound on a bobbin while being gripped by a slit-like groove formed on the bobbin end along a peripheral circle of the bobbin, and being followed by a transfer tail. The method comprises the steps of severing the wrapped yarn coil at a position on the bobbin end in which the slit-like groove does not exist; while holding one of the served ends of the wrapped yarn coil by suction, gripping the severed end by gripper; and while rotating the gripper in the twisting direction so that a twist is imparted to the wrapped yarn coil and displacing the gripper away from the bobbin, rotating the bobbin in the unwinding direction so that the wrapped yarn coil is removed from the slit-like groove.

An apparatus is provided for removing a wrapped yarn coil of an initial yarn portion of a package arranged on the lateral side of a conveyor for transporting a tray carrying a package, the wrapped yarn coil being wound on a bobbin while being gripped by a slit-like groove formed on the bobbin end along a peripheral circle of the bobbin, and being followed by a transfer tail. The apparatus comprises trays for carrying the packages thereon; a driving means arranged on one side of a conveyor for transporting the trays, for rotating the package; a cutting means arranged on the other side of the conveyor confronting the driving means, for severing the wrapped yarn coil; a yarn suction means for sucking the severed wrapped yarn coil; a seal delivery means for fixing an end of the transfer tail to the bobbin end by adhering a seal on the end of the transfer tail by a seal holding device movable upward/downward and/or forward/backward; and a yarn twisting means for gripping and rotating the severed end of the wrapped yarn coil. The yarn suction means is connected with means movable forward/backward relative to the package; the yarn twisting means and cutting means are connected with means movable upward/downward and/or forward/backward; and the yarn twisting means comprises a gripper consisting of a pair of movable elements associated with each other to occupy open and closed positions, the gripper being connected with a rotational driving shaft.

A method is provided for removing a wrapped yarn coil wherein the seal is adhered onto a bobbin end at a position at which the transfer tail yarn is in contact with the bobbin surface, so that the transfer tail yarn is fixed on the bobbin. The seal is delivered from a seal delivery means carried on a seal mat, received by a seal suction pad and transported thereby to the position through the up/down and forward/backward motions of the seal suction pad.

An apparatus is provided for removing a wrapped yarn coil wherein the yarn suction means comprises a yarn sucker for sucking and holding one end of the severed wrapped yarn coil and another yarn sucker for sucking and removing the wrapped yarn coil withdrawn from the bobbin. The latter sucker has a vertical U or V-shaped guide at a tip end thereof.

An apparatus is provided for removing a wrapped yarn coil wherein the cutting means is a hot air type cutter.

An apparatus is provided for removing a wrapped yarn coil wherein the tray has a rotatable bobbin holder for supporting the package in a horizontal position, at a rear end of which is attached a drive connector with a tapered opening to be engaged with a rotational driving means.

An apparatus is provided for removing a wrapped yarn coil wherein the means for rotationally driving the package has at a tip end of the driving shaft thereof a taper sleeve corresponding to the tapered opening of the drive connector in the tray and movable in the axial direction by a power cylinder.

An apparatus for removing a wrapped yarn coil wherein the drive connector to be engaged with the driving means is connected with a rear end of a shaft of the bobbin holder to be movable in the axial direction, and is provided with a brake plate corresponding to a brake pad arranged behind the drive connector. A spring is inserted between the drive connector and the bobbin holder shaft for pressing the brake pad to brake the bobbin holder, which is released by the pushing action of the driving means so that the drive connection is obtained.

A method is provided for removing a wrapped yarn coil wherein the yarn severing position is determined by the steps of detecting levels of a groove or a recess formed at a predetermined position on the bobbin and a reference surface without the groove or the recess by first and second sensors, respectively, while rotating the package by a motor having a rotational angle detector; obtaining a difference between the levels detected by the two sensors; obtaining a position of the groove or recess by the rotational angle corresponding to the level difference; and determining a surface area of the bobbin end to be a yarn severing position based on the position of the groove or recess.

A method is provided for removing a wrapped yarn coil wherein the first and second sensors are a distance sensor.

A method is provided for removing a wrapped yarn coil wherein a yarn position on the bobbin end is detected from an image represented by binary values. The method comprises the steps of irradiating an ultraviolet ray onto the bobbin end so that a secondary excitation beam is irradiated from yarns wound on the bobbin end; receiving the secondary excitation beam by a photosensor to convert the same to an image signal; obtaining a binary image signal from the image signal; determining a true value of a yarn position at which a yarn is fixed by a seal or a yarn severing position after correcting a yarn position measured by the binary image signal by adding a correcting value for correcting a detection error accompanied with the binary conversion. The correcting value is predetermined through a number of measurements in accordance with various yarn kinds and yarn thicknesses.

A method is provided for removing a wrapped yarn coil wherein the displacement of the yarn cutting means or the seal delivery means is controlled by an output signal of the true value.

A method is provided for removing a wrapped yarn coil wherein the yarn position corresponds to an innermost edge of a wrapped yarn coil farthest from the bobbin end surface.

A method is provided for removing a wrapped yarn coil wherein the yarn position is determined by the steps of detecting wrapped yarn coils having a width larger than a predetermined value, based on the binary image signal; selecting one of the detected wrapped yarn coils farthest from the bobbin end surface; and determining a yarn position as an edge of the selected wrapped yarn coil farthest from the bobbin end surface.

A method is provided for removing a wrapped yarn coil wherein a yarn severing position is determined by adding a predetermined margin to a true value of the yarn position.

A method is provided for removing a wrapped yarn coil comprising the steps of irradiating an ultraviolet ray onto the bobbin end so that a secondary excitation beam is irradiated from yarns wound on the bobbin end; receiving the secondary excitation beam by a photosensor to convert the same to an image signal; and obtaining a binary image signal from the image signal.

A package treating conveyor line is provided comprising a two-storied line body having upper and lower parts for transporting packages while carrying the respective package on a tray, the parts having a conveyor for circulating the tray; loading and unloading lifters arranged at the respective ends of the line body, for elevating and lowering the package. Each lifter has a subconveyor for circulating the tray, and a plurality of package handling means arranged between both the lifters along the line body.

A package treating conveyor line is provided wherein a wrapped yarn coil removing apparatus is provided corresponding to the conveyor in the upper part.

A package formed by a take-up machine is transferred to a tray placed on a loading lifter positioned at a front end of a package treating conveyor line. Then the package is transferred to an upper conveyor of the conveyor line via an upper floor of the loading lifter. The package is subsequently transported by the conveyor and handled by package handling means such as a wrapped yarn coil peel-off device. Finally the package is delivered to an unloading lifter positioned at a rear end of the conveyor line and lowered to a lower floor, in which the package is removed from the tray and transported to a subsequent process. The empty tray is returned to the loading lifter through the lower conveyor and the same steps are repeated so that the circulation is continued.

According to the present invention, the wrapped yarn coil severed by the peel-off device of this conveyor line is gripped at one end thereof by a gripper. The wrapped yarn coil is peeled off from the bobbin by the displacement of the gripper in the direction away from the bobbin or by the rotation of bobbin itself in the unwinding direction, while the gripper is rotated to twist the yarn. Thereby the wrapped yarn coil is easily and assuredly removed from the slit without leaving any broken filaments therein, irrespective of yarn thicknesses, even in a slit having a larger yarn gripping force. This ensures a smooth yarn unwinding operation without disturbance by a residual broken filament in the slit and the reuse of the bobbin. Further, a widthwise dimension of the package treating apparatus becomes very small, whereby the whole size of the system can be miniaturized, installation cost is lowered and the maintenance thereof is improved.

Prior to carrying out the severing operation of the wrapped yarn coil on the bobbin end, a position of a slit or recess on the bobbin surface is detected by distance sensors while the bobbin is rotated by a servo-motor with a rotational angle sensor, so that a surface area on the bobbin end in which a yarn severing position should be defined is determined based on the detected position. In addition, a yarn position in the bobbin axial direction (positions of a wrapped yarn coil and a pigtail for forming a transfer tail) is detected by processing an image represented by binary values, and the detected value is used a control signal for a yarn severing means or a seal delivery means for fixing a pig tail.

BRIEF DESCRIPTION OF THE DRAWINGS

These and other objects and advantages of the present invention will be more apparent with reference to the preferred embodiments illustrated in the attached drawings, wherein.

DESCRIPTION OF THE PREFERRED EMBODIMENTS

Figure 1:
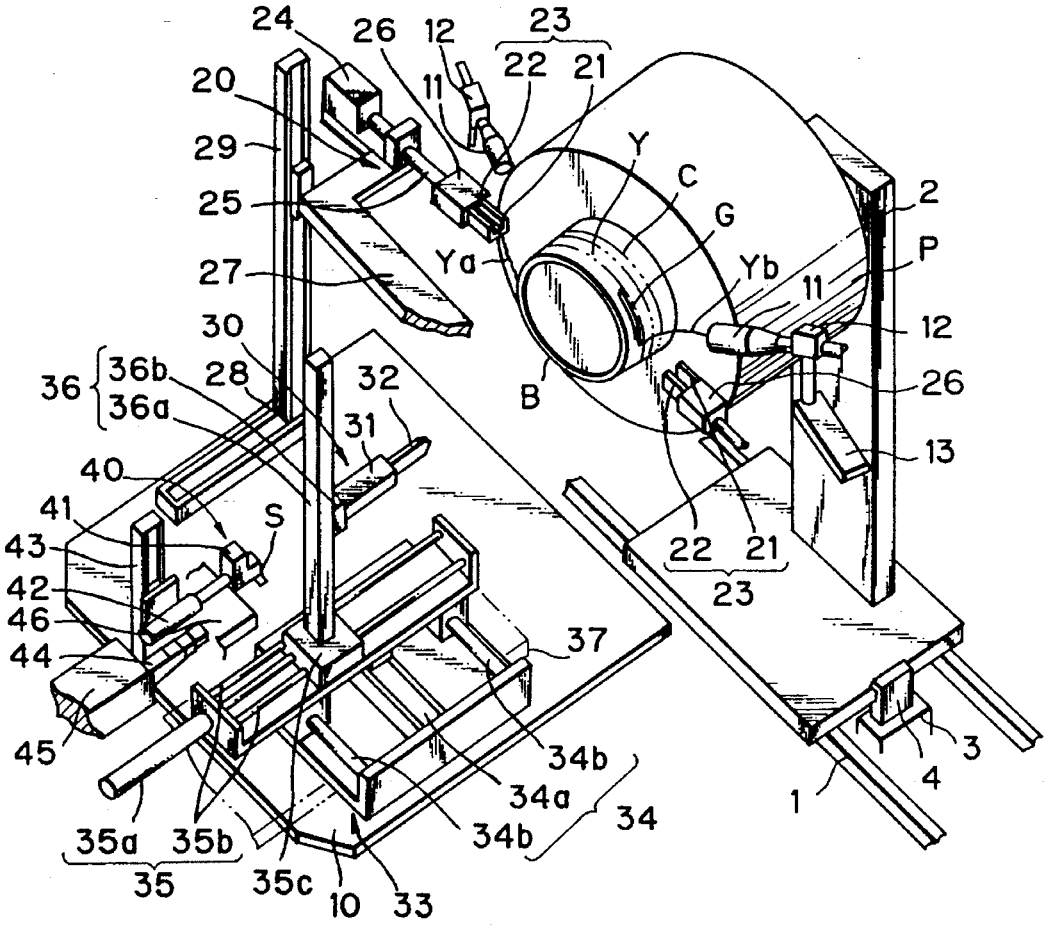
FIG. 1 is a perspective view of one embodiment of the apparatus according to the present invention.

In FIGS. 1, 2A–2F and 3A–3D, on a machine frame 10 are provided a seal delivery device 40 for fixing an end of a transfer tail onto a bobbin end, a yarn gripping device 20 for gripping a curled end of a wrapped yarn coil and a yarn severing device 30 comprising a yarn cutter.

In front of the machine frame 10 is arranged a conveyor 1 for transporting a tray 2 for carrying a yarn package P thereon. The tray 2 on which the package P is fixedly carried is transported by the conveyer 1 and accurately stops at a predetermined position by the action of a stopper 4 fixed in front of the machine frame 10.

A pair of yarn suckers 11 are arranged confronting each other at positions corresponding to the left and right sides of an area in front of the yarn package P stopped at the predetermined position. The yarn sucker 11 is mounted on an arm (not shown) by a bracket 12 and a plate 13. The arm is movable forward and backward along an end surface of the package P by a power cylinder or a motor. The yarn gripping device 20 includes a motor 24 fixed on an arm 27 movable forward and backward as well as upward and downward, a box 26 connected with a driving shaft 25 of the motor 24 to be rotatable thereby, and a gripper 23 consisting of a pair of movable elements (one may be stationary) actuated by a power cylinder or electromagnetic force in a scissor-like motion. The box 26 is directly connected with the shaft 25 in the illustrated embodiment, but it is usual to be rotatable by a belt via a rotary actuator or the like. The arm 27 is mounted on a power cylinder 29 reciprocatably movable upward and downward. The power cylinder 29 is in turn mounted on a power cylinder 28 in a vertically projected manner. The power cylinder 28 is fixed on the machine frame 10 and reciprocatably movable perpendicular to the conveyor running direction. Accordingly, the arm 27 can be displaced upward and downward as well as forward and backward by the action of the power cylinders 28, 29 so that the yarn gripping device 20 (gripper 23) is subjected to the above directional movements.

An edge 32 of the cutter 31 on the yarn severing device 30 is provided projecting in the direction perpendicular to the conveyor (package) running direction and movable upward and downward, leftward and rightward, as well as forward and backward by a cylinder assembly 33 described later. The edge 32 may be of an electrical hot blade type or a mechanical cutting blade type. As such, the edge may sometimes be liable to damage a bobbin surface, so that a hot air type is more preferably used.

A cylinder device 33 by which the cutter 31 is subjected to a three dimensional movement includes a first cylinder assembly 34 consisting of a power cylinder 34*a* reciprocatably operable in a direction parallel to the running direction of the conveyor and a pair of guide rods 34*b* arranged on the respective sides of the power cylinder 34*a*, a second cylinder assembly 35 consisting of a power cylinder 35*a* mounted on the first cylinder 34 reciprocatably operable in a direction perpendicular to the running direction of the conveyor and a pair of guide rods 35*b*, and a third cylinder assembly 36 consisting of a power cylinder 36*a* fixed on a slider 35*c* of the second cylinder assembly 35 and reciprocatably operable upward and downward. The cutter 31 is fixed on a slider 36*b* carried by the power cylinder 36*a* to be reciprocatably movable upward and downward. The yarn severing device 30 may be provided on a table 37 (shown in a chain line) secured on the machine frame 10 to be movable forward and backward by a servo-motor, a pulse motor or the like in order to accurately adjust a severing position in the axial direction of the bobbin.

The seal delivery device 40 includes a seal sucking pad 41, a pair of power cylinders 42, 43 for displacing the seal sucking pad 41 forward and backward as well as upward and downward relative to the package P and a seal feeding device 45 for forwarding a seal mat 44 to transfer a seal S to the seal sucking pad 41, and mounted on the machine frame 10 at a location on the lateral side of the yarn severing device, by a table 46 movable forward and backward relative to the package P. In this regard, the seal delivery device may be placed on the table 37.

In the thus-structured apparatus, first, the tray 2 carrying the package P is transported, for example, by a chain conveyor 1. In this connection, the package P has been preliminarily fixed on the tray 2 so that a predetermined severing portion of a wrapped yarn coil formed on the bobbin end is accurately positioned by an automatic detecting method disclosed in Japanese Unexamined Patent Publication No. 64-14337 or Japanese Unexamined Patent Publication No. 6-191733, or another peel-off position detecting means or manually. Note that the severing portion of the wrapped yarn coil is usually positioned so that a bobbin surface C on which no slit-like groove G is formed is on the upside, but other positions can also be selected.

When the package P fixed on the tray 2 has reached a predetermined position in front of the apparatus according to the present invention, a positioning device 3 is operated to elevate the stopper 4 so that the tray 2 is made to stop to accurately position the package P. Upon the completion of this positioning operation, as shown in FIGS. 2A–2F, the yarn severing device 30 is forwarded to the package P by the action of the second cylinder assembly 35. When the cutter 31 (edge 32) is displaced above the severing portion, it is close to or in contact with the wrapped yarn coil Y by the upward/downward motion and/or the forward/backward motion to sever the wrapped yarn coil Y while leaving a necessary transfer tail T. In this connection, as shown in FIGS. 2A–2F, it is assumed that the bobbin rotates clockwise and the yarn is wound counterclockwise as seen from the front side of the package.

In this case, the cutter 31 is preferably of a hot air type. In the hot air type cutter (heater), the edge 32 has a narrow slit-like hot air ejecting orifice. When the orifice is positioned in the widthwise direction of the wrapped yarn coil at a distance of 3 mm therefrom and a hot air with an average temperature 250° C. is ejected at a flow rate of 100 ml/min, the usual wrapped yarn coil of 50 denier polyester filament having 8 mm width can be melt-broken within 2 seconds. A temperature distribution curve on the bobbin surface caused by this hot air type cutter has a very sharp rectangular shape in which the temperature sharply drops by more than 100° C. at a position 1 mm apart from the boundary of the orifice, so that the hot air does not adversely influence other areas. Accordingly, no damage or trace is at all imparted on the bobbin surface.

Figure 2A:
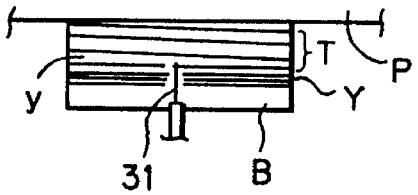
FIGS. 2A through 2F illustrate steps of a method using the apparatus of FIG. 1.
Figure 2B:
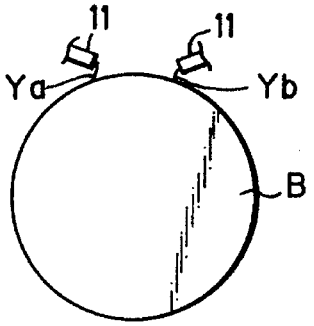

As shown in FIG. 2B, since the yarn sucker 11 is forwarded to the wrapped yarn coil Y by the action of the power cylinder not shown and positioned at a location above and in the vicinity of the wrapped yarn coil, the respective ends Y*a*, Y*b* of the severed wrapped yarn coil Y can be easily sucked into the yarn sucker 11.

Figure 2C:
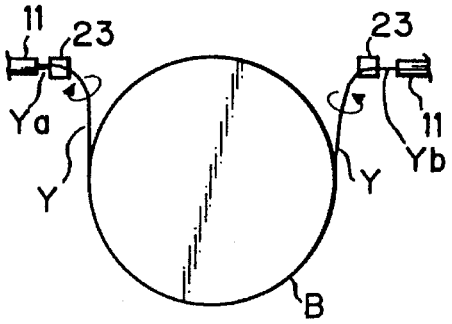

When the yarn sucker 11 is thereafter retreated on the lateral side, the power cylinder 28 is operated to forward the gripper 23 to grip the wrapped yarn coil Y extending between the yarn sucker 11, maintaining the yarn end Y*a* or Y*b* in a sucked state, and the bobbin (see FIG. 2C).

Figure 2D:
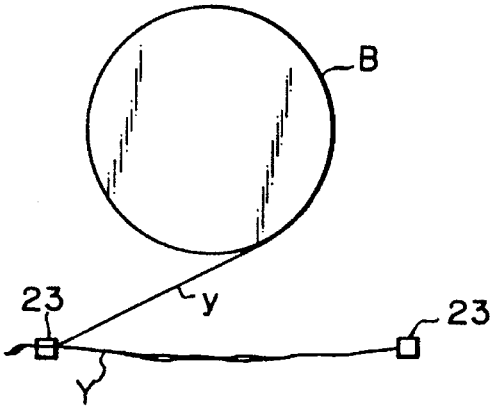
Figure 2E:
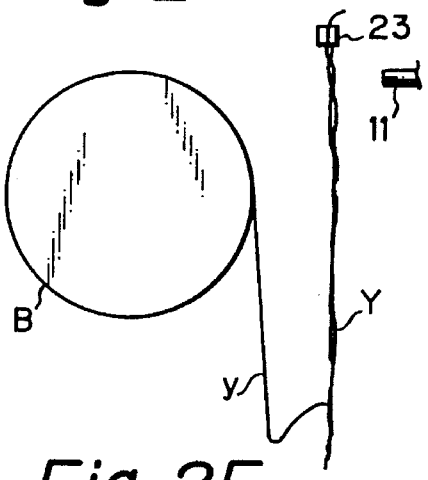

The sucking operation of the yarn sucker 11 is temporarily interrupted by this grip. Upon interruption of the sucking operation, the motor 24 starts to drive the gripper 23 to rotate while the yarn Y is held thereby (FIG. 2C). The yarn Y gripped by the gripper 23 is twisted by this rotation to be distorted in the rotational direction. As the gripper 23 is lowered while rotating in accordance with the descending motion of the power cylinder 29, filaments composing the yarn tightly fitted in the slit-like groove are collected together, whereby the yarn is assuredly and completely removed from the slit-like groove G because no filament breakage occurs during the withdrawal thereof. If the yarn has been wound counterclockwise, a yarn portion y extending to the package P is being sucked and held by the lefthand yarn sucker 11 in FIG. 2C and gripped by the same side gripper 23 together with the severed wrapped yarn coil Y. When both the grippers 23 are lowered to a position below the bobbin B and the yarn fitted in the slit-like groove G is removed from the bobbin, as shown in FIG. 2D, the lefthand gripper 23 is opened so that the severed wrapped yarn coil Y is gripped only by the righthand gripper 23. Then both the grippers 23 are elevated in accordance with the upward motion of the power cylinder 29 so that the severed wrapped yarn coil Y is positioned in front of the righthand yarn sucker 11 (FIG. 2E).

Thereafter, the yarn sucker 11 is operated to remove the severed wrapped yarn coil Y when the gripper 23 releases the same.

Figure 2F:
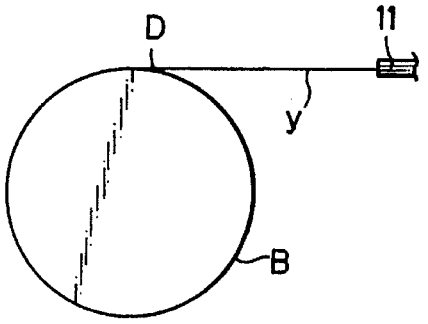

In this case, a yarn portion y forming a transfer tail consisting of several coils wound on the bobbin and extending to the package P is also sucked at one end thereof by the yarn sucker 11 and held in a tensed state between the yarn sucker and the upper surface of the bobbin as shown in FIG. 2F. In the state shown in FIG. 2F, the seal sucking pad 41 receives a seal S from 10 the seal mat 44 delivered from the seal feeding device 45, and holds the same by suction. The seal S is then conveyed by the seal pad 41 in accordance with the upward/downward motion and/or the forward/backward motion of the power cylinders 42, 43 to a position D on the bobbin B at which the yarn portion y is in contact with the bobbin surface, and stuck thereon to fix the same.

Next, the yarn severing device 30 moves to cut the excessive yarn end at a position between the bobbin and the yarn sucker 11, whereby a yarn package P having a transfer tail y of a predetermined length is formed.

When the package P having the end-fixed transfer tail y is thus formed, the grippers 23 and yarn suckers 11 are retracted to the original positions, then the stopper is released, so that the tray carrying the finished package P is moved out from the system by the conveyor and, instead, a fresh package to be handled is introduced into the system. The same sequence is repeated on the fresh package, whereby the treatment of the tail yarn can be effectively and quickly carried out.

Another method for removing a wrapped yarn coil and forming a transfer tail will be described below with reference to FIGS. 3A through 3D.

Figure 3A:
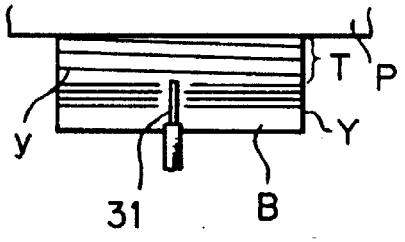
FIGS. 3A through 3D illustrate modified steps of the above.
Figure 3C:
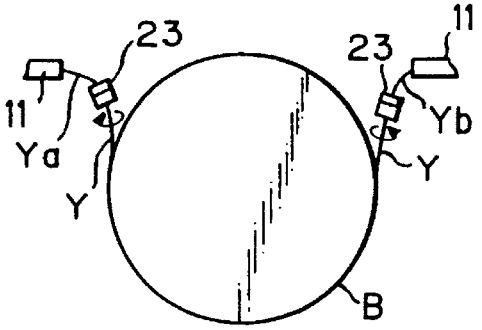
Figure 3B:
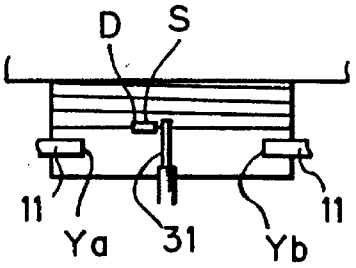
Figure 3D:
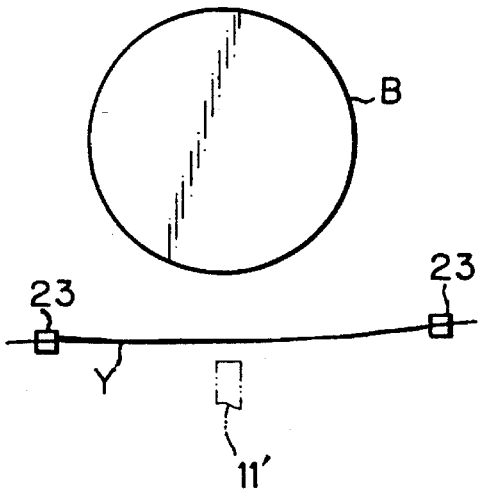
Figure 4:
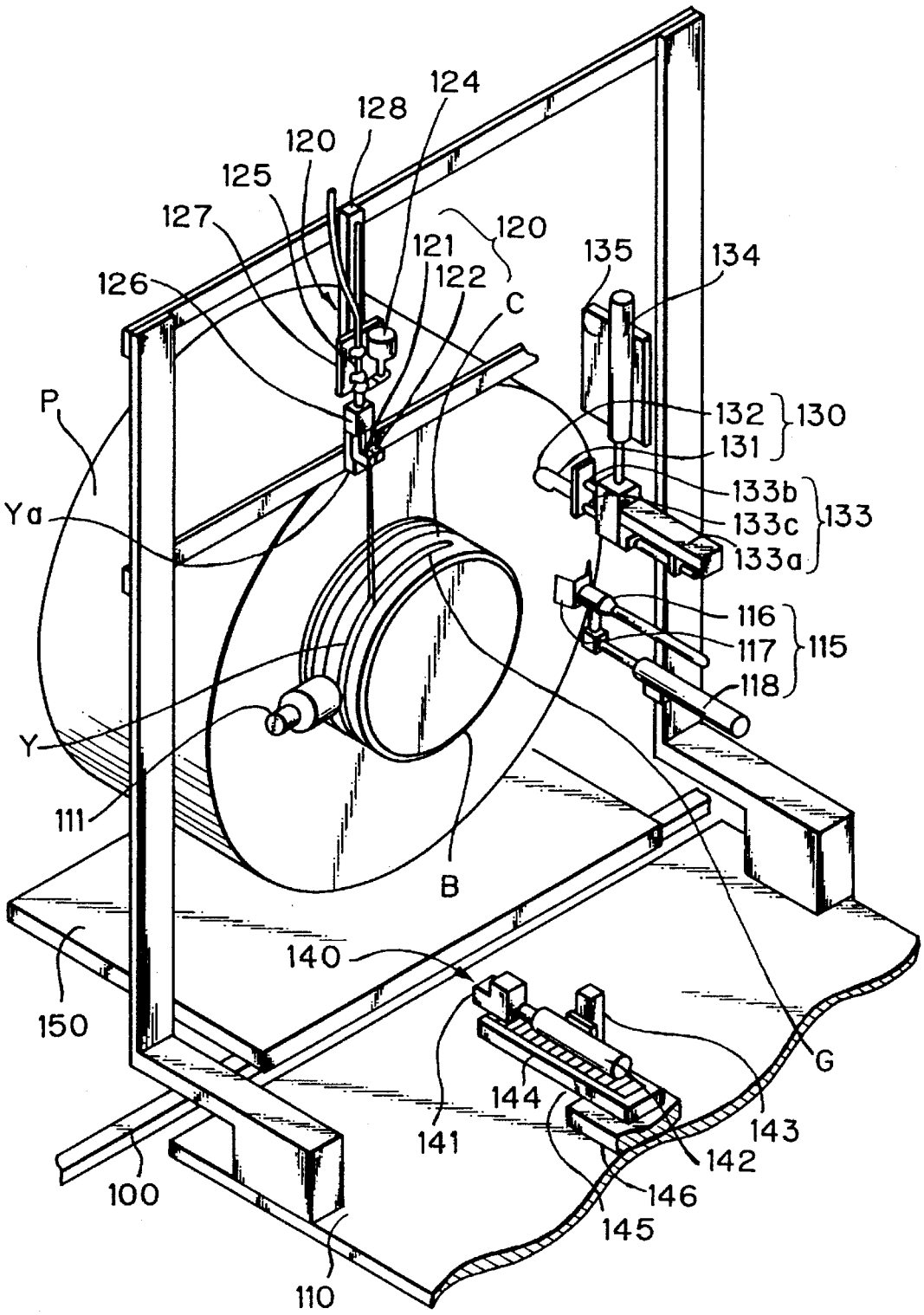
FIG. 4 is a perspective view of another embodiment of the apparatus of the invention.

As shown in FIGS. 3A and 3B, substantially the same steps are carried out as before until the wrapped yarn coil Y is severed by the cutter 31 and the yarn ends Y*a*, Y*b* are sucked by the left/righthand yarn suckers 11. Thereafter, while maintaining this state or while retracting the yarn sucker 11 to the bobbin ends, the seal sucking pad 41 is moved to a position D on the bobbin at which an end of a yarn portion to be a transfer tail y is in contact with the bobbin surface in accordance with the upward/downward motion and/or the forward/backward motion of the power cylinders 42, 43 and the seal S is stuck on the transfer tail yarn y formed at a predetermined position. While this position is always definite because the transfer tail is wound substantially in the same pattern, it may be accurately detected by a suitable sensor.

Next, the yarn cutter 31 is moved to the position D and severes the transfer tail yarn at a position on the releasing side (righthand side, seen from the front side of the bobbin) of the sealed position. At this time, if the yarn sucker 11 has been retreated to the bobbin end, at least the righthand yarn sucker 11 seen from the front side of the bobbin occupies a position suitable for easily sucking the severed yarn portion extending to the wrapped yarn coil Y so that the severed yarn portion is suckingly held by the yarn sucker together with the wrapped yarn coil.

Thereafter, as shown in FIG. 3C, when the yarn sucker 11 is retracted to the side of the bobbin B in a similar manner as described before, the grippers 23 are moved forward by the action of the power cylinder 28 to grip the wrapped yarn coil Y which is held at the respective ends by the yarn suckers 11 and are in contact with the bobbin surface at the middle portion thereof.

Suction of the yarn suckers 11 is temporarily interrupted by this grip. Upon the interruption of suction, the motor 24 starts to drive the grippers 23 in rotation while holding the yarn group Y thereby. Due to this rotation, the yarn group Y gripped by the grippers 23 is twisted to be distored in the rotational direction.

As the grippers 23 are lowered while rotating by the descending motion of the power cylinder 29, the yarn tightly fitted in the slit-like groove of the bobbin can be completely and assuredly removed therefrom without any filament breakage because filaments composing the yarn are collected together by the rotation. When both the grippers 23 are lowered to a position below the bobbin B so that the wrapped yarn coil is taken out from the slit-like groove G and is free from the bobbin, the wrapped yarn coil is sucked and removed by another yarn sucker 11' disposed below the bobbin end or the original yarn sucker 11 displaced to the corresponding position. Thus, the wrapped yarn coil is completely cleaned.

In this connection, the fixing of the transfer tail y by a seal may be executed prior to the severing operation of the wrapped yarn coil. Also the method for fixing a transfer tail is not limited to the above one. Another embodiment of a method and apparatus for carrying out the fixing of the transfer tail will be described below with reference to the drawings, which is more effective, space-saving and compact in size.

In FIGS. 4, 5A, 5B and 6A–6D, on a machine frame 110 are provided a yarn removal sucker 115, a yarn gripping device 120 for gripping a severed end of a wrapped yarn coil wound on the bobbin end, a yarn severing device 130 comprising a yarn cutter, and a seal delivery device 140 for fixing an end of a transfer tail on the bobbin end.

A conveyor 100 is arranged in front of the machine frame 110, for transporting a tray 150 carrying a yarn package P. The tray 150 carrying the package P thereon is made to stop at a predermined position in front of the machine frame 110 by the action of the aforesaid stopper (not shown) and is accurately positioned thereby.

In front of a position corresponding to the package P stopped at the predetermined position, a yarn sucker 111 is provided. The yarn sucker 111 is mounted on an arm (not shown) movable forward and backward along the end surface of the package P by a power cylinder, a motor or the like.

The yarn gripping device 120 comprises a motor 124 fixed on a plate 127 movable upward/downward and forward/backward, a rotatable box 126 connected with a driving shaft 125 with which is associated a rotary actuator connected with the motor 124 via a belt (in this embodiment, while a belt is used for the convenience of explanation, the rotary actuator may be directly connected with a gear or a driving shaft of the motor for rotation), and a gripper 123 for gripping a yarn comprising a pair of movable elements 121, 122 (one may be stationary) built into the box 126 and actuated to be in a scissor-like open/close state by a power cylinder, not shown, or an electromagnetic force.

The plate 127 is mounted on a power cylinder 128 fixed on the machine frame 110 while directed vertically to the running direction of the conveyor to be reciprocatedly movable upward/downward, so that the yarn gripping device 120 (gripper 123) moves upward/downward along with the plate 127.

A cutter 131 of the yarn severing device 130 is adapted so that an edge 132 thereof is projected vertically to the running direction of the conveyor (package) and is movable upward/downward and forward/backward by a cylinder assembly described later. While the cutter edge is of an electric heater type in this embodiment, a knife edge type may be used. However, this touch type edge is sometimes liable to damage the bobbin surface, so that a hot air type is more preferable as described later.

The cylinder assembly for displacing the cutter 131 includes a power cylinder 133 with a cylinder body 133*a*, a plunger 133*b* movable in the direction vertical to the running direction of the conveyor and a guide rod 133*c* arranged in parallel to the plunger. The cutter 131 is attached to this power cylinder 133. Another power cylinder 134 is fixed on the machine frame by a plate 135 via a bracket so that a plunger thereof is actuated in the up/down direction. The cylinder body 133*a* is fixed at the tip end of this plunger of the power cylinder 134. The plate 135 is movable forward/backward by a servo-motor or a pulse motor so that the severing position in the axial direction of the bobbin can be accurately adjusted as stated before.

On the machine frame 110 at a position on the upper left side of the yarn severing device 130 is provided the yarn removal sucker 115 by a bracket not shown, including a sucker 116 having a guide 117 with a V-shaped horizontal cross-section at a tip end thereof and a power cylinder 118 for moving the sucker 116 forward/backward relative to the bobbin.

The seal delivery device 140 includes a seal sucking pad 141 having a structure described before and a pair of power cylinders 142, 143 for displacing the seal sucking pad 141 relative to the package P upward/downward and forward/backward, and a seal feeder 145 for forwarding a seal mat 144 to feed a seal S to the seal sucking pad 141, and mounted on the machine frame 110 at a position on the lateral side of the yarn severing device 130 by a table 146 movable left/rightward and forward/backward relative to the package P by means of a servo-motor or the like, not shown.

If the yarn severing device and the seal delivery device are moved forward/backward by a servo-motor or the like, other power cylinders which are also used as a forward/backward displacing means can be eliminated. While the yarn severing device 130 is provided, in this embodiment, at an upper position, it may be positioned adjacent to the seal delivery device 40 in a side-by-side manner as shown in FIG. 1, preferably on the plate 146.

A tray 150 for transporting a package includes a main body 151, a base plate 152 for supporting the main body 151, a column 153 having a channel-like cross-section and standing upright on the base plate 152, and a package holding device 155 mounted on a pedestal 154 attached on the top surface of the column 153. The package holding device 155 is provided with a bobbin holder 157 rotatably supported by a bearing 156 fixed on the pedestal 154. The bobbin holder 157 includes a hollow body **157*a* having on the periphery thereof a plurality of axial slits 158 formed at a predetermined angular position, each accommodating a chucking hook 159 therein for gripping the package from inside, a spring 161 arranged in a retainer 160 fixed in the interior of the hollow body 157*a* for biasing the respective chucking hook 159 in the radial direction to be projected outside from the slit 158, and a shaft 157*b* integral with the hollow body 157*a* and supported by the bearing 156. The chucking hook 159** may be arranged in the peripheral direction and formed by an elastically deformable ring body.

The rear end of the shaft **157*b* is formed as a spline shaft or provided with an axial groove 162, with which a drive connector 163 having a corresponding groove or rib is engaged to be movable in the axial direction. The drive connector 163 has a hollow portion 164 on the side closer to the rear end of the shaft 157*b*, forming a conical surface for connecting with a driving device, and a flange 165 on the outer side of the hollow portion 164 operated as a brake plate. A brake band or pad 168 is provided while confronting the flange 165 on a plate 167 supported by a bracket 166 fixed on the column 153**.

A coil spring 171 is arranged between a retainer ring 169 and shoulder 170 formed on the front side of the drive connector 163 so that the flange 165 of the drive connector is always pressed on the surface of the brake pad 168 by the resilient force of the spring 171. A ring 180 is fitted on the bobbin holder 157 to be movable along an axial groove 181 formed on the bobbin holder 157 when the bobbin is pushed out of the bobbin holder.

In the thus-structured apparatus, a yarn package is automatically donned onto the bobbin holder 157 by a loading device not shown. Prior to the donning, the chucking hook 159 is in a raised position pushed by the spring 161 as shown in FIG. 5B. When the bobbin is loaded on the bobbin holder 157, the spring 161 is compressed to generate a force always pressing the inner wall of the paper tube or the bobbin, whereby the package mounted on the bobbin holder 157 is tightly held thereby so that the package is stably transported without unfavorable displacement or a slipping off of the package from the bobbin holder.

The package thus mounted on the tray is transported between the respective automatic end yarn treating apparatuses. During the transportation, the brake pad 168 and the flange 165 are always pressed to each other by the spring 171, whereby the bobbin holder 157 is stationary as if it is fixed on the pedestal 154.

When the package P fixed on the tray 150 reaches a predetermined position in front of the apparatus according to the present invention, the stopper device is actuated to elevate the stopper so that the tray 150 is made to stop. Thus the package P can be accurately positioned.

In this connection, the wrapped yarn coil formed on the bobbin end of the package P must be accurately positioned by a known automatic detection thereof or manually prior to the transportation, for example, by a chain conveyor 100. In this embodiment, the package P is positioned so that the plain bobbin surface C on which the slit-like groove G is not formed is on the upside. Otherwise the yarn severing operation by the cutter applied to the wrapped yarn coil from the upside would be interfered with by the slit-like groove. However, other positions of the package may be selected if the yarn severing operation is carried out in a different manner.

After the tray has been positioned, a taper sleeve 175 having a conical shape in correspondence with the shape of the hollow portion 164 of the drive connector 163 (the shape of the taper sleeve may vary if the drive connector is of a spline type or a groove type) and attached to a transmission shaft 174 of a motor 173 of a driving device 172, is fitted into the drive connector 163 to be pressingly in contact with the inner wall of the hollow portion 164. Thus the connection between the drive connector and the motor results. The spring 171 is compressed by the pressure of the taper sleeve 175, whereby the flange 165 is separated from the brake pad 168. Thus the bobbin holder 157 supported by the bearing 156 is free from the brake and is rotatable. When the torque is transmitted to the drive connector 163, the bobbin holder 157 is driven to rotate the package.

Figure 5A:
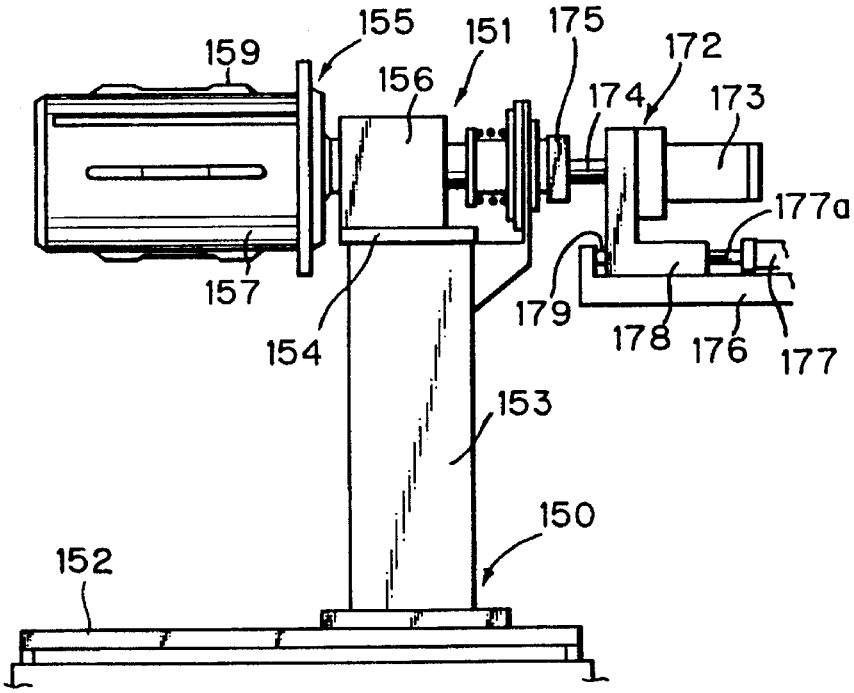
FIG. 5A is a side view of a tray for transporting a package and a rotational driving means.
Figure 5B:
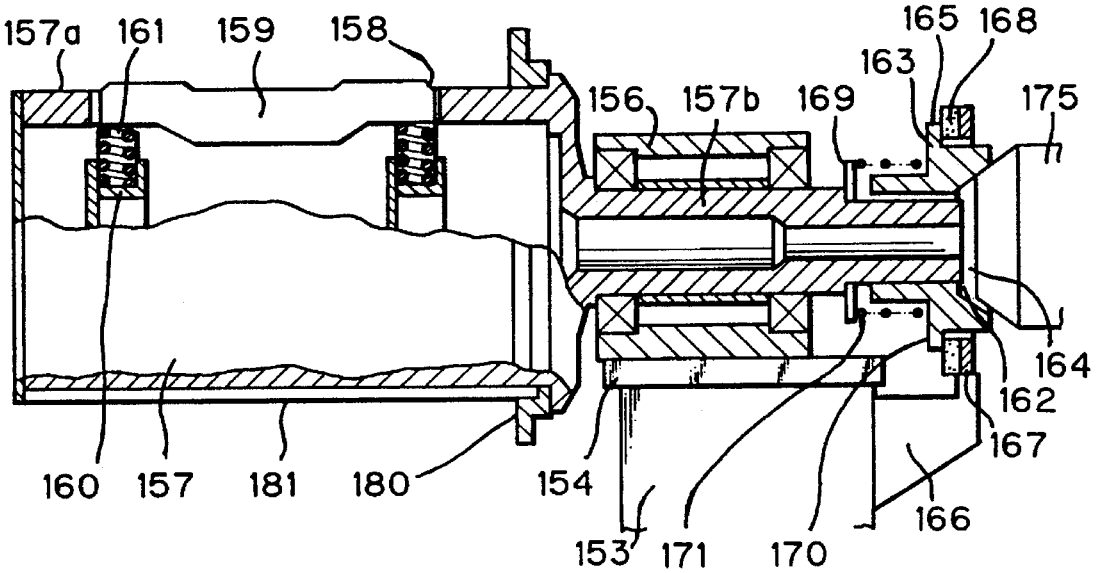
FIG. 5B is a partial broken enlarged view of a main part of FIG. 5A.

As shown in FIG. 5A, the driving device 172 has the drive motor 173 (typically an air type, but another type of device such as an electrical type may be used) fixed on a base 178 movable forward/backward by a power cylinder 177 mounted on the frame 176. The transmission shaft 174 (taper sleeve 175) is arranged in line with the axis of package P. The drive motor 173 is moved forward by the action of a plunger **177*a* of the power cylinder 177 so that the taper sleeve 175 is fitted into the drive connector 163 and connected with the shaft 157*b*. Reference numeral 179 represents a guide rod. Although the whole driving device 173 is displaced to move the taper sleeve 175** in this embodiment, other means may be adopted to move the taper sleeve alone.

Figure 6A:
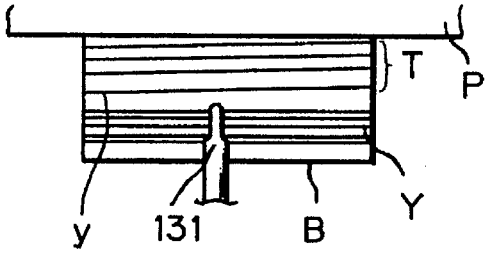
FIGS. 6A through 6D illustrate steps of a method of the invention.

Thereafter, as shown in FIG. 6A, the yarn severing device 130 is moved forward to the package P by the action of the power cylinder 133. When the cutter 131 (edge 132) reaches a position directly above the severing position, the cutter is moved to at least touch the wrapped yarn coil Y to sever the same while leaving a necessary transfer tail T. It is assumed that the bobbin rotates clockwise during the package formation, whereby the yarn is wound counterclockwise, as seen from the front side in FIGS. 6A–6D.

In this case, a hot air type cutter 131 is most preferable as stated before.

Figure 6C:
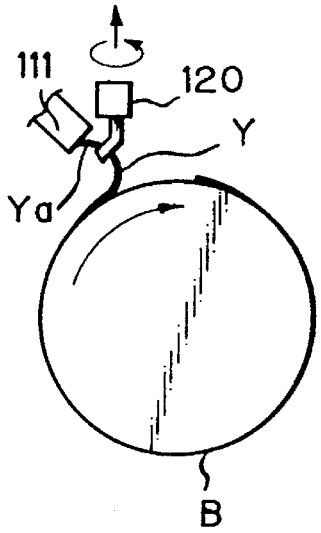
Figure 6B:
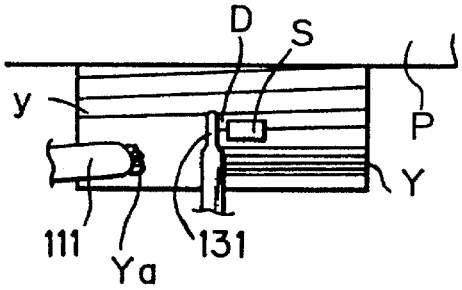

Since the yarn sucker 111 is moved forward by the action of the power cylinder, not shown, to the wrapped yarn coil Y to occupy a position above and closer to the same as shown in FIG. 6B, the severed end Y*a* of the wrapped yarn coil is easily sucked into the yarn sucker 111.

Thereafter, the yarn sucker 111 is retracted to a position on the lateral side of the bobbin B and the gripper 123 is moved forward by the action of the power cylinder 128 to grip the wrapped yarn coil Y held at one end Y*a* by the yarn sucker 111 and connected at the other end with the bobbin (FIG. 6C).

The sucking operation of the yarn sucker 111 is temporarily interrupted after this grip. Then the motor 124 starts the rotation so that the gripper 123 is made to rotate while holding the wrapped yarn coil Y (FIG. 6C). According to this rotation, the yarn held by the gripper 123 is twisted to be distorted in the rotational direction.

The gripper 123 is elevated by the action of the power cylinder 129 while continuing the rotation. Simultaneous therewith, the motor (or rotary actuator) of the taper sleeve 175 engaged with the drive connector starts the rotation in the yarn peeling direction. The bobbin (package) carried by the bobbin holder 157 is also rotated thereby and the yarn tightly fitted in the slit-like groove G can be assuredly withdrawn therefrom without any filament breakage.

Figure 6D:
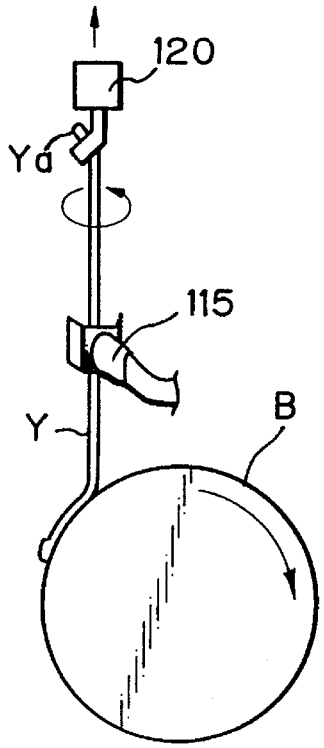

Before the yarn is completely removed from the slit-like groove G, the yarn removal sucker 115 in the suction state is applied to the yarn being peeled off from the groove (FIG. 6D). Therefore, the tail end of the yarn Y is immediately sucked into the yarn removal sucker 115 when the same is released from the slit-like groove G. Then the peeled-off yarn is completely sucked into the yarn removal sucker 115 when the gripper 123 is opened.

In this regard, an end of a yarn portion y forming a transfer tail on the bobbin by a coil of several turns is preferably fixed prior to the peel-off operation of the wrapped yarn coil so that the suction does not adversely influence the transfer tail. This is done by the following steps. The seal sucking pad 141 receives the seal S from the seal mat 144 delivered from seal delivery device 145. The seal sucking pad 141 transfers the seal S sucked thereon in accordance with the up/down motion and/or the forward/backward motion of the power cylinders 142, 143 to a position D at which the transfer tail yarn y is in first contact with the bobbin surface. The seal S is stuck on the bobbin surface to fix the end of the transfer tail yarn at the position D. While the position D is always preliminarily definite because the transfer tail is formed in the same pattern, this position may be determined by using a sensor.

Next, the yarn severing device 130 is moved to sever the excessive free end of the transfer tail y adjacent to the seal S. Thereafter, the above peel-off operation is executed and the package P with a predetermined transfer tail y can be obtained.

After the package P has been obtained, on which the transfer tail y is fixed by the seal at the end thereof, the gripper 123 and the yarn sucker 111 are retracted to the original positions, then the stopper is released so that the transportation of the tray 150 by the conveyor is started to remove the package P from the system. Instead, a package to be freshly handled is introduced, on which the same operational sequence is repeated, whereby the effective handling of the package yarn end is executed.

The fixing of the transfer tail y by the seal may be carried out prior to the severing of the wrapped yarn coil, so that both yarns can be severed by a single application of the cutter. This fixation of the transfer tail by the seal may be carried out at any stage other than that described above.

Figure 7:
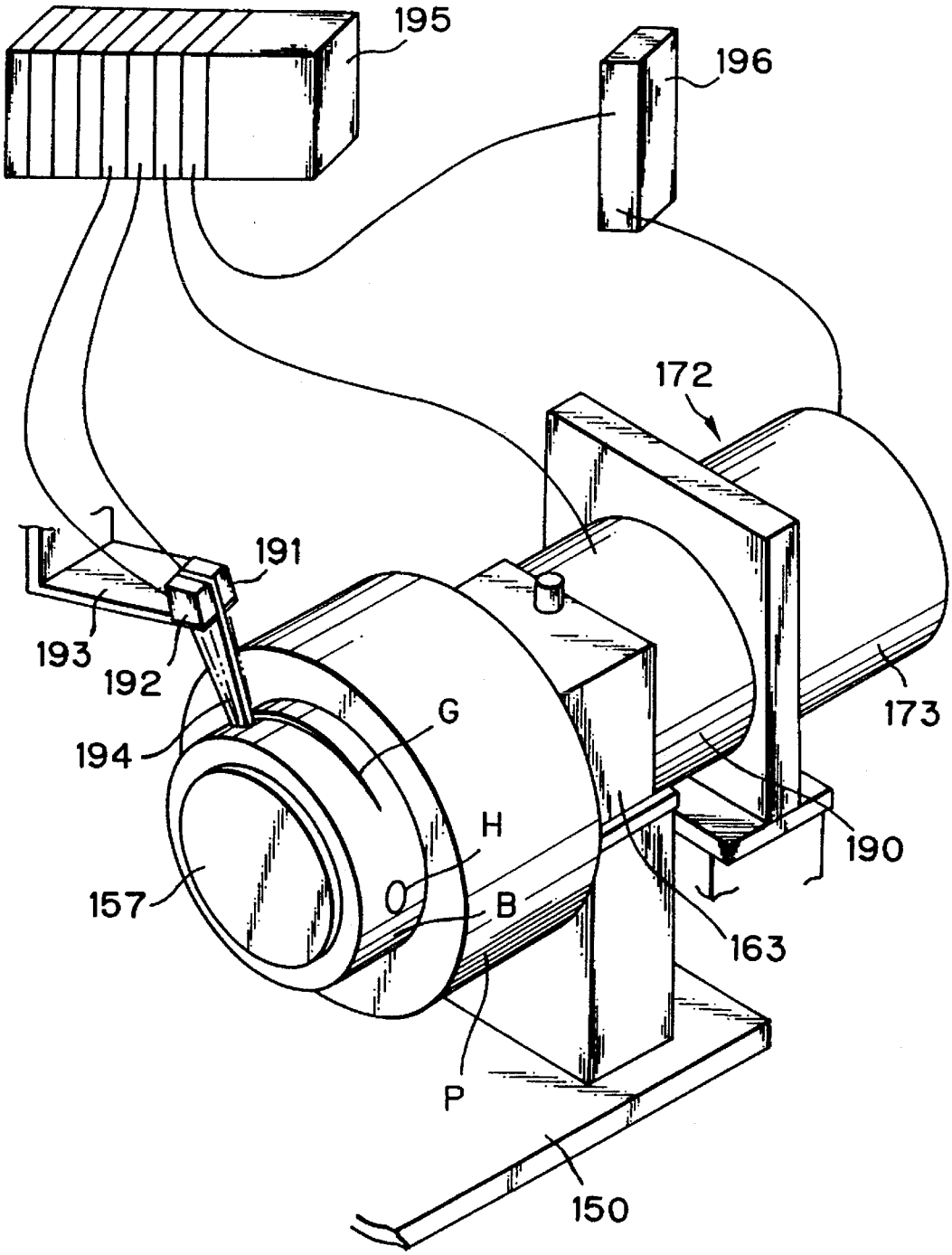
FIG. 7 is a perspective view of an apparatus for detecting a severing position of a wrapped yarn coil on a bobbin end according to the present invention.

According to the above embodiment, the bobbin is positioned so that a plain surface without a slit-like groove G is at the upside to avoid the coincidence of the severing position with the groove G, because the severing operation is carried out from the upside. A preferable method for positioning the bobbin (package) in such a manner will be described below with reference to FIG. 7.

The package P is transported while being supported by the bobbin holder 157 mounted on the tray 150, and is made to stop by the stopper arranged at a predetermined location to be accurately positioned. At this position, a driving device 172 for rotating the package P stated above, provided with the driving motor 173 (servo-motor), is forwarded so that the taper sleeve attached to the transmission shaft of the motor is engaged with the drive connector 163 of the tray 150 to cause the package P held by the bobbin holder 157 to be rotatable.

A rotary encoder 190 comprising a gear-like rotating disc with indents on the periphery and a luminescent body for emitting light beams to the former (instead, a magnet type may be used) is mounted in front of the servo-motor 173. A pair of distance sensors, i.e., a first distance sensor 191 and a second distance sensor 192 are supported in a side-by-side manner with a small distance therebetween by a bracket 193 at the upper position above the bobbin end. The first and second distance sensors 191 and 192 are, respectively, used for detecting the slit-like groove G on the bobbin end and a reference surface (flat surface) of the bobbin end on which no groove G exists, and are arranged corresponding to these positions. These sensors may be either fixed at a definite position or mounted on a movable body which can be displaced to the above-mentioned position on the bobbin when needed. When a command is issued from an operating sequencer 195 to a motor driver 196, the servo-motor 173 is driven to rotate the package P (normally one turn). While measuring the rotational angle by the rotary encoder 190, the first distance sensor 191 scans a peripheral circle of the bobbin surface having the slit-like groove G and the second distance sensor 192 scans a peripheral circle of the bobbin surface having no slit-like groove G. Note that a light insulating separator 194 extending downward closer to the bobbin surface is provided between both the distance sensors 191, 192 to avoid interference therebetween.

A signal issued from the second distance sensor 192 is always constant, corresponding to a distance between the sensor and the flat bobbin surface. While, a signal issued from the first distance sensor 191 is equal to that issued from the second distance sensor 192 when the first distance sensor 191 scans a flat area of the bobbin surface, but becomes larger when scanning the groove G, because a depth of the groove is added to the distance between the sensor and the flat surface. Accordingly, if the signals issued from both the sensors are input to an operating sequencer 195 to obtain a difference therebetween, a zero level value is obtained when the first distance sensor 191 scans the flat area, while a plus level value is obtained when it scans the groove G. Thus, a position of the groove G is promptly and accurately determined as the rotational angle detected by the rotary encoder 190 when the plus level value is obtained from the operating sequencer 195.

Thereafter, the bobbin is further made to rotate by a predetermined angle determined based on the above rotational angle corresponding to the position of the groove G so that the flat surface on which the subsequent treatment is carried out is on the upside, while the groove G is on the underside. Then a subsequent operation such as a severing operation for the wrapped yarn coil is carried out on the flat surface of the bobbin end. In this connection, usually several tens of turns, in the extreme case, several hundred turns of yarn are wound on and/or in the vicinity of the slit-like groove G.

The above embodiment relates to a case in which the slit-like groove G is directly detected for determining a severing position. However, when a yarn forming a package is thick, it may be difficult to detect the slit-like groove G because the groove is liable to be completely concealed by the wrapped yarn coil. In such the case, a recess H may be provided other than the groove G at a certain position easily detectable. The rotation of the bobbin is made to stop when the recess H has been detected and then the severing position is determined while referring to this stop position. If the recess H is provided in an arena without the groove G, the stop position itself may be selected as the severing position. Alternatively, the bobbin is made to further rotate by a predetermined angle so that an area without the groove G is positioned at a proper position.

The position of the slit-like groove G or the recess H may be detected by using means other than the distance sensor described above.

Since the wrapped yarn coil and/or the transfer tail yarn Y are not always wound at a definite position, a length of the transfer tail yarn remaining on the bobbin after the wrapped yarn group has been severed may vary. Particularly if the packages of different yarn kinds are handled, this tendency is significant. Of course, a slight difference is permissible in the length of transfer tail but packages with transfer tails having a length as equal as possible are desirable for the handling in the subsequent processes.

This transfer tail of a definite length can be preferably obtained by a method as described below.

Figure 8:
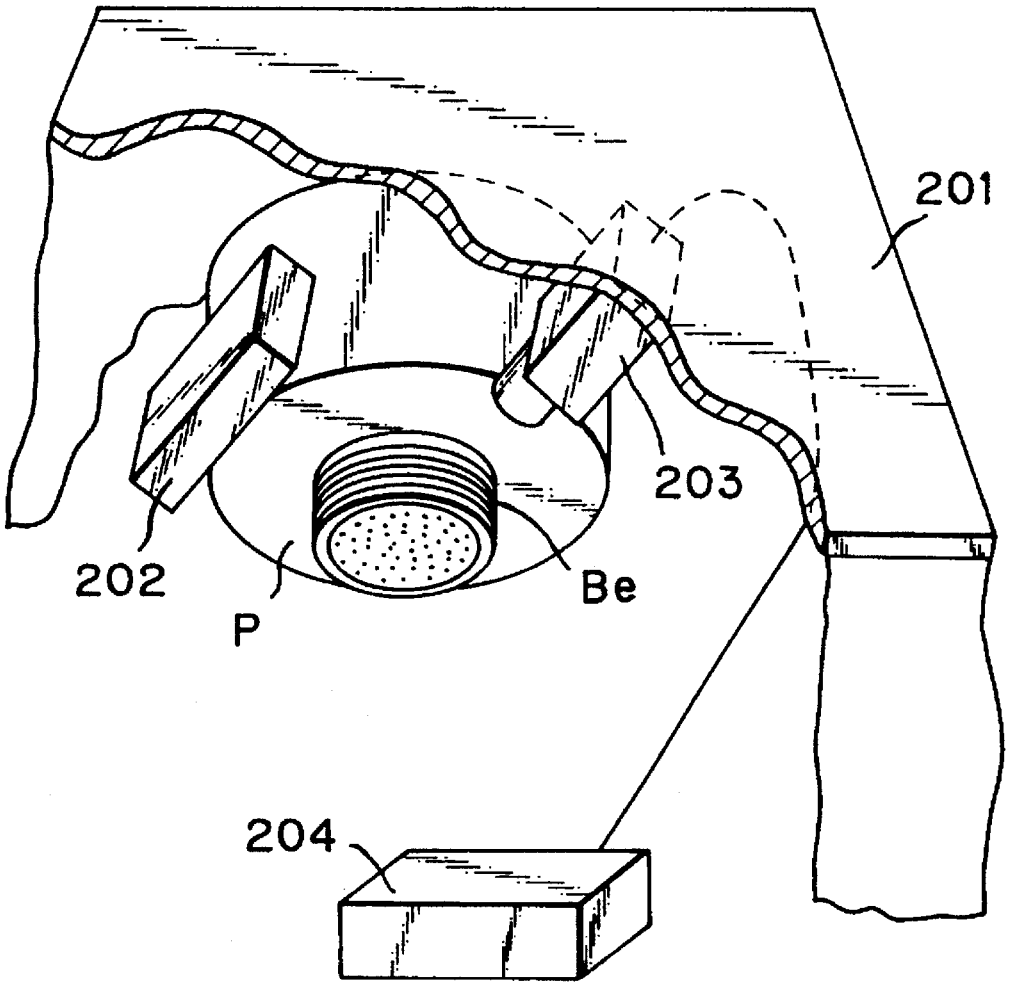
FIG. 8 is a perspective view of main part of an apparatus for detecting positions of yarns on a bobbin end according to the present invention.

FIG. 8 shows a diagramatic view of an apparatus for carrying out this method. A package P is set at a predetermined position in a shelter shielded by a blackout curtain 201 from noise. An ultraviolet ray generator 202 is provided in the shelter so that the ultraviolet ray is irradiated therefrom to a bobbin end B*e* of the package P. A camera 203 including a CCD element is provided for receiving a secondary excitation beam from a yarn portion on the bobbin end B*e*, so that an image signal of the bobbin end B*e* of the package P is obtained. A controller 204 is provided for controlling the camera 203. In this embodiment, type VX-4200 marketed by Keence K. K., is used as a controller. The controller converts an image signal to a binary signal and executes predetermined measurements of the binary image, the results of which are output therefrom. The signals are input into an arithmetic unit comprising a personal computer, not shown. The arithmetical unit detects the innermost position of the wrapped yarn coil based on the output from the camera 203, then detects the severing position thereof and outputs a signal representing the severing position to a severing and peeling-off device. The wrapped yarn coil on the bobbin is severed and peeled off in the severing and peel-off device so that a transfer tail of, for example, more than 1.5 turns is formed.

The ultraviolet ray generator 202 is adapted to radiate a near-ultraviolet ray suitable for detecting a synthetic yarn such as polyester fiber yarn or polyamide fiber yarn having a wave length distributed in a range of from 300 nm through 400 nm and having a peak at 360 nm. When the bobbin end B of the package P is irradiated by the near-ultraviolet ray, this portion formed by a paper body directly reflects all the components of the incident ray. If there is a yarn in this portion, a component of the incident ray having a predetermined wave length, for example, in a range of 320 nm through 360 nm is absorbed and instead, a secondary excitation beam having a wave length in a range of 400 nm through 500 nm is irradiated therefrom.

The camera 203 uses a CCD (charge coupled device) image pickup element having a higher sensitivity to rays having a wave length in a range of about 400 nm through 700 nm and a lower sensitivity for others, so that the above secondary excitation beam is well detected.

Figure 9:
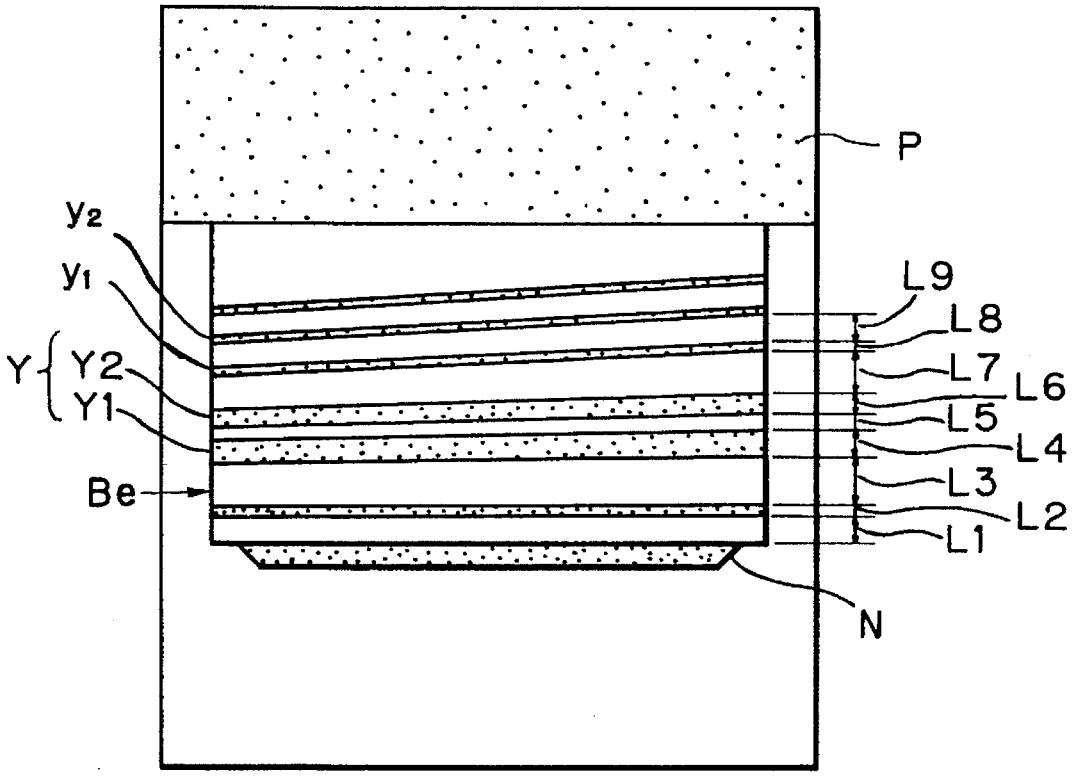
FIG. 9 is a schematic plan view of a binary image of a bobbin end obtained by the apparatus of FIG. 8.

The controller 204 compares the image signal with a predetermined threshold value .and converts the former to a binary value. FIG. 9 illustrates one example of a typical image of the bobbin end B*e* represented by a binary signal. The controller 204 has capabilities for executing predetermined measurements of number, length, area or the like of the wrapped yarn coil based on the image signal converted to a binary value. In this embodiment, the length measurement function is selected. That is, a boundary between the higher and lower levels of the binary value is indicated as an edge. A distance between the adjacent edges is measured as a length value. Signals corresponding to the following lengths shown in FIG. 9 are output from the controller 204; a distance L1 between an extreme end surface of bobbin and an adhered coil, a width L2 of coil, a distance L3 between the coil and a first pig bunch (wrapped yard coil) Y1, a width L4 of the first pig bunch Y1, a distance L5 between the first pig bunch Y1 and a second pig bunch Y2, a width L6 of the second pig bunch Y2, a distance L7 between the second pigtail Y2 and a first pigtail (a signal yarn) y2, a width L8 of the first pigtail y1, and a distance L9 between the first pigtail y1 and a second pigtail y2.

Figure 10:
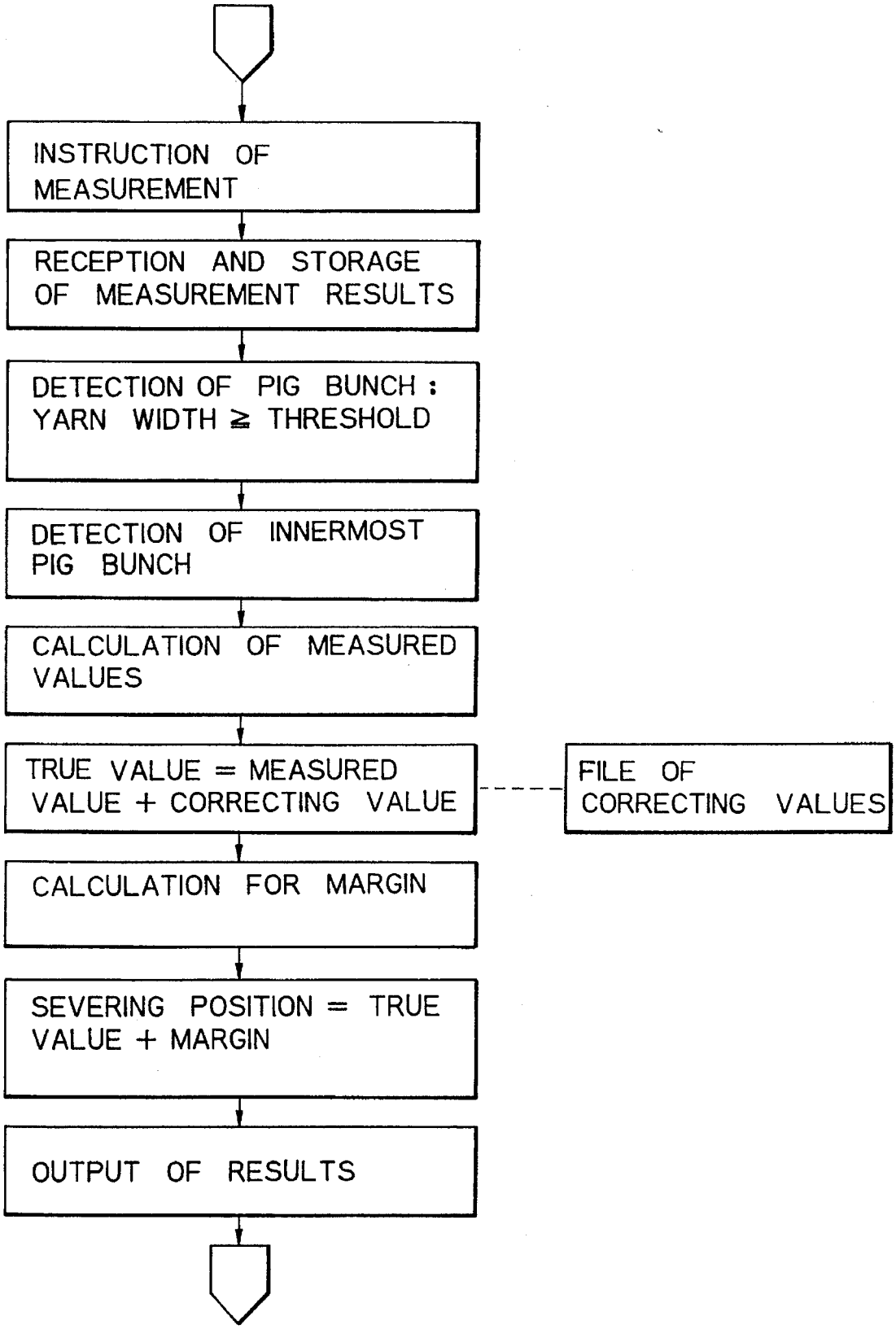
FIG. 10 is a flowchart for the operation carried out in an arithmetical unit of a controller.

The arithmetical unit determines, in accordance with a routine shown in FIG. 10, the innermost position of the wrapped yarn coil Y based on these lengths, and then the severing position.

In this connection, there is a case in which no coil is adhered on the bobbin end whereby L1 and L2 are not observed, or the pig bunch is not divided into two parts, contrarily to the case in FIG. 9. Accordingly, the higher level areas in the binary image signal corresponding to the coil and the yarn on which the reflecting beam exists; that is, L2, L4, L6 and L8; are detected. After measuring the width of the respective higher level area, the pig bunch is determined as the area having a width larger than a predetermined constant. Next, among the pig bunches determined by the above procedure, one positioned farthest from a nylon plate N fixed at a bobbin end surface; i.e., the second pig bunch Y2 is selected. Then a distance between the bobbin end surface and the upper edge (as seen in FIG. 9) of the second pig bunch Y2; i.e., a positional value (L1+L2+L3+L4+L5+L6); is obtained. A correcting value is searched for from a correcting file in which various correcting values preliminarily determined by experiments in accordance with a thickness of material chip of the yarn are stored, so that a proper value corresponding to the yarn kind of the package to be handled is obtained. This correcting value is added to the positional value to be a true value of the wrapped yarn position. Further a margin is added to this true value, which is about 20 or 30% of a distance between the second pig bunch Y2 and the first pigtail y1, to obtain the severing position for the wrapped yarn coil. An output signal corresponding to this severing position is transmitted to the servo-motor for controlling the displacement of the yarn severing device.

A pigtail severing position for forming a predetermined length of pigtail (transfer tail yarn) is determined substantially in the same manner as above. That is, first, a pigtail nearest to the severing position for the wrapped yarn coil (in the drawing, the first pigtail y1) is selected. A distance between the bobbin end surface and the uppermost edge (seen in FIG. 9) of the first pigtail; i.e., (L1+L2+L3+L4+L5+L6+L7+L8); is calculated. A correcting value corresponding to the yarn to be treated as described before is added to this calculated value to obtain a true value of the position of the first pigtail y1. Further a margin is added to this true value, which is 20 or 30% of a distance between the first pigtail y1 and the second pigtail y2, to obtain the pigtail severing position. An output signal corresponding to this severing position is transmitted to the servo-motor for controlling the displacement of the seal delivery device.

According to the above procedure, it is possible to accurately determine a yarn severing position while avoiding the influence of the adherent coil or the divided pig bunch in the wrapped yarn coil. When the measured value is merely used as in the prior art, an automatic yarn peel-off operation may be possible by modifying the measured value to match with this yarn type. In such a case, however, this automatic yarn peel-off operation may not be stably and smoothly carried out due to the erroneous severing position if the yarn type is different. On the contrary, according to the present invention, the severing position can be very accurately detected even if the yarn type changes.

As stated above, it is possible to accurately determine a yarn severing position while avoiding the influence of the adherent coil or the divided pig bunch in the wrapped yarn coil. In addition, the severing position can be very accurately detected even if the yarn type changes, whereby a stable yarn peel-off operation with no erroneous handling can be always expected.

Methods and apparatuses according to the present invention described above in detail are effectively used when they are built into a conveyor line directed to a further handling process, a storage process, a packaging process or the like, so that a continuous operation is possible. An embodiment of such a package handling conveyor line which is systematized as one unit to be compact and highly effective, will be explained below.

Figure 11:
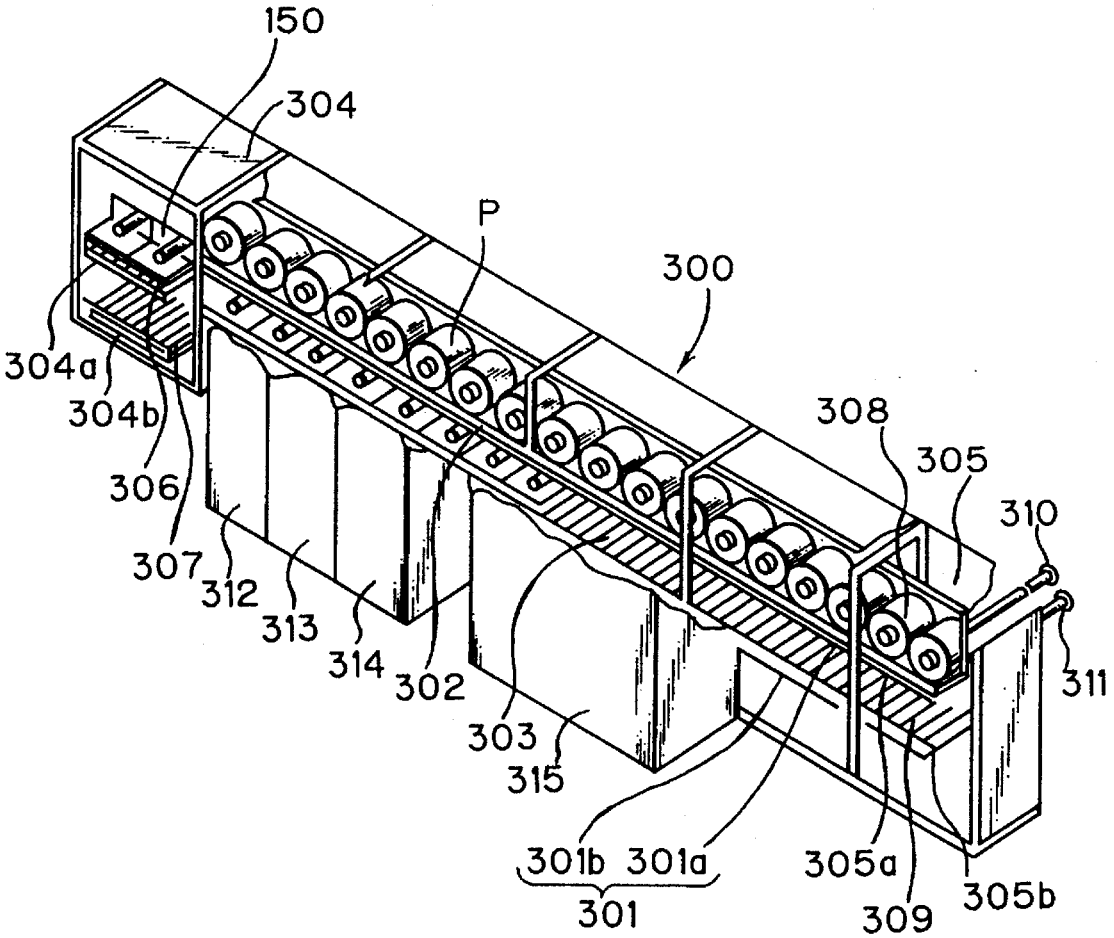
FIG. 11 is a schematic perspective view of a package handling conveyor line according to the present invention.

FIG. 11 is a schematic perspective view of a package handling conveyor line. A two-storied line body 301 comprises upper and lower parts 301*a* and 301*b* including conveyors 302, 303, respectively, for circulating trays 150 for carrying a package P. At the respective ends of the line body, lifters 304 and 305 are provided for loading and unloading the package P. The lifters 304 or 305 have upper and lower floors 304*a*, 304*b* and 305*a*, 305*b*, respectively, corresponding to the line body 301. These floors have subconveyors 306, 307, 308 and 309, respectively, for circulating the tray 150.

In front of (or on the backside of) the line body 301, the following devices are arranged in series between the loading and unloading lifters 304 and 305; a yarn peel-off device 312 for peeling off an outermost layer yarn or an outermost bunch yarn as disclosed in Japanese Unexamined Patent Publication No. 61-140473 and Japanese Unexamined Patent Application No. 6-191733, a yarn end knotting device 313 as disclosed in Japanese Examined Utility Model Publication No. 1-20368, a device 314 for peeling off the wrapped yarn coil on the bobbin end and removing the same, and a package inspecting device 315 for checking appearance, weight or the like; so that the package P is subjected to predetermined handling and inspection. While devices other than those described before are arranged in this embodiment, the latter devices may be built into this line as they are or after divided into more than two parts. Further the respective steps carried out by these devices may be rearranged in series to form a novel line. Pushers 310, 311 are provided on the backside of the lower floor of the unloading lifter 305, for discharging the package P having been subjected to the necessary handling, from the tray 150.

A package P formed as a material yarn package by a yarn take-up machine is temporarily stocked in a storage, not shown. The package is then taken out from the storage as one in a lot of the same kind of packages under the supervision of a computer controlling a product delivery program and transported to a loading machine by a delivery conveyor, which is finally transferred to the package handling conveyor line 300.

The package handling conveyor line 300 has a predetermined number of trays 150 on the conveyors 302, 303 so that the trays circulate along the line via the conveyors 302, 303 and the lifters 304, 305. At first, the package P is inserted by the loading machine, not shown, to a bobbin holder of the tray 150 on the upper subconveyor 306 of the loading lifter 304 lowered to a level flush with the lower part 301*b* of the line body. In this regard, a pair of trays 150 are placed on the upper conveyor 306 in the side-by-side manner and the package is automatically delivered to the respective tray. However, the present invention should not be limited to this method.

When the package P has been loaded on the upper floor 304*a* of the lifter 304 by the tray 150, the lifter 304 is elevated to a level flush with the upper conveyor 302 and made to stop at this position, so that the lower subconveyor 307 of the lifter 304 is flush with the lower conveyor 303 of the line body. Then a pair of empty trays 150 waiting on the lower conveyor 303 are transferred to the lower subconveyor 307 by the movement of the lower conveyor 303 for the preparation of the next package loading operation by the loading machine.

When the tray 150 carrying the package P and positioned on the upper floor 304*a* has been transferred to the upper conveyor 302 of the line body by the movement of the conveyor 306, the lifter 304 is further elevated to a level at which the tray 150 on the lower floor 304*b* is flush with the upper conveyor 302 of the line body. The tray 150 is transferred in the same manner to the upper conveyor 302 operated as an upper transporting line simultaneously with or after the movement of the tray 150 of the selection treatment.

The empty lifter 304 from which the tray has been removed is lowered to a level at which the upper floor 304*a* of the lifter is flush with the lower part 301*b* of the line body. The empty tray 150 waiting on the lower conveyor 303 of the line body is transferred to the lifter 304 by the movement of the conveyor 303 for executing the transportation of the package P while repeating the above steps.

The peel-off operation for the outermost layer yarn of the package, the end yarn knotting operation and the removal operation for the wrapped yarn coil wound on the bobbin end are sequentially executed on the package P carried on the tray 150 transferred to the conveyor 302 of the line body and finally the inspection for appearance and weight of the package is carried out. While the inspection for appearance and weight of the package is preferably at a final stage, the sequence of these operations may be optionally changed such that the yarn peel-off operation and the removal operation for the wrapped yarn coil are reversed.

Upon carrying out this operation, the package P is stationary at the respective predetermined position described before by means for positioning the tray 150, such as a stopper or the like projected between the conveyors. The positioning of the tray may be carried out by other means.

When the handling of package P has been completed by this package handling conveyor line, the tray 150 is transferred to the upper floor 305*a* of the unloading lifter 305, and then to the lower part 301*b* of the line body by the descent of the lifter 305. At the position on the lower part 301*b*, pusher devices 310 and 311 are provided for pushing out the package P from the tray 150. The package P is pushed forward by this pusher device to be transported to the subsequent process. The empty tray 150 is transferred to the lower conveyor 303 of the line body, then to the loading lifter 304 through the conveyor 303 and is used in a circulating manner.

Although the respective lifter 304, 305 has upper and lower floors in the above embodiment, it is possible to have only one floor. Regarding the unloading lifter, the pusher device may be provided on the lifter itself or separately therefrom. Although two trays 150 circulate as a group in the above embodiment, the number of trays in one group may be optionally selected, such as one or more than three. The conveyor, particularly the conveyor 302, 303 of the line body, may be formed as a combination of a plurality of subconveyors of either the same type or different types. The power cylinder used in the above embodiments is usually of a compressed air type but may be of a pressurized liquid type. Of course, a mechanical or an electrical equivalent means can be used instead of a fluid pressure cylinder, provided the former has the same functions as the latter.

As described above, according to the present invention, even in a bobbin having a slit adapted to have a larger yarn gripping ability, a yarn caught in the slit can be completely and easily removed while leaving no broken filaments irrespective of the yarn thickness and under the same conditions. Thereby, even a bobbin having a saw-toothed slit can be reused without unsmooth unwinding of yarn due to the residual filaments in the slit. Further, since it is possible to minimize a widthwise dimension of the apparatus to a great extent, an overall size of the system becomes compact, the installation cost can be reduced, and a maintenance becomes easier. Since a yarn severing surface area or position on a bobbin end is quickly and accurately determined based on a slit for catching a yarn or a recess, an automatic handling of the package P becomes possible without man power.

In a package handling conveyor line in which a large number of packages delivered from a yarn production process are handled, an installation space of the line and a time for transporting the packages can be saved by arranging the line in a three-dimensional manner contrary to the conventional planner arrangement. Also, a sufficient space for installing devices for handling the packages is available on the respective sides of the line. In addition, a delivery of the package after being graded by an inspection process can be carried out in an optional manner by increasing a degree of freedom of the unloading lifter incorporated in the line.

We claim:

1. An apparatus for removing a wrapped yarn coil of an initial yarn portion of a package; said wrapped yarn coil being wound on a bobbin while being gripped by a slit-like groove formed on the bobbin, and being followed by a transfer tail yarn; comprising a cutting means for severing the wrapped yarn coil to produce two severed ends at a position on a bobbin end in which the transfer tail yarn exists, a pair of yarn suction means for holding the two severed ends of the wrapped yarn coil by suction, a seal delivery means for fixing one end of the transfer tail yarn to the bobbin end by adhering a seal on the end of the transfer tail yarn, a pair of yarn gripping means for gripping the two severed ends of the wrapped yarn coil, said yarn suction means being arranged on the left and right sides of the bobbin end while confronting each other, said yarn gripping means comprising a gripper consisting of a pair of movable elements associated with each other to occupy open and closed positions and a driving device for rotating the gripper.

2. An apparatus for removing a wrapped yarn coil of an initial yarn portion of a package; said wrapped yarn coil being wound on a bobbin while being gripped by a slit-like groove formed on the bobbin, and being followed by a transfer tail yarn; comprising:

a driving means for rotating the package along an axis of the package to unwind the wrapped yarn coil, a cutting means for severing the wrapped yarn coil to produce two severed ends at a position on a bobbin end in which a transfer tail yarn exists, a yarn suction means for holding one end of said two severed ends of the wrapped yarn coil by suction, a seal delivery means for fixing one end of the transfer tail yarn to the bobbin end by adhering a seal on the end of the transfer tail yarn, and a yarn twisting means for gripping the one end with a gripper and rotating the gripper away from the bobbin, as the bobbin is rotated by the driving means to unwind the coil from the slit-like groove.

3. An apparatus for removing a wrapped yarn coil as defined by claim 2, wherein the yarn suction means comprises a first yarn sticker for sucking and holding one end of the severed wrapped yarn coil and a second yarn sucker for sucking and removing the wrapped yarn coil from the bobbin; the second yarn sucker having a vertical U or V-shaped guide at a tip end thereof.

4. An apparatus for removing a wrapped yarn coil as defined by claim 2 or 3, wherein the cutting means is a hot air type cutter.

5. An apparatus for removing a wrapped yarn coil as defined by claim 2, further comprising a tray for carrying the package thereon, said tray including:

a rotatable bobbin holder for supporting the package in a horizontal position, a drive connector attached at a rear end of said bobbin holder and having a tapered opening to be engaged with the driving means.

6. An apparatus for removing a wrapped yarn coil as defined by claim 5, wherein the driving means has a driving shaft with a tip end and a taper sleeve at the tip end corresponding to the tapered opening of the drive connector in the tray and movable in an axial direction of the package.

7. An apparatus for removing a wrapped yarn coil as defined by claim 5 or 6, wherein the drive connector to be engaged with the driving means is connected with a rear end of a shaft of the bobbin holder to be movable in the axial direction relative to the package, and is provided with a brake plate corresponding to a brake pad arranged behind the drive connector; a spring being inserted between the drive connector and the bobbin holder shaft for pressing the brake pad to brake the bobbin holder, which is released by the pushing action of the driving means so that the drive connection is obtained.

8. A method for removing a wrapped yarn coil of an initial yarn portion of a package; said wrapped yarn coil being wound on a bobbin while being gripped by a slit-like groove formed on the bobbin end along a peripheral circle of the bobbin, and being followed by a transfer tail yarn; comprising the steps of severing the wrapped yarn coil to produce two severed ends at a position on the bobbin end in which the slit-like groove does not exist, while holding the two severed ends of the wrapped yarn coil by suction, gripping the two severed ends with grippers, and removing the wrapped yarn coil from the slit-like groove along the periphery of the bobbin while rotating the grippers to impart a twist to the wrapped yarn coil held by the grippers.

9. A method for removing a wrapped yarn coil of an initial yarn portion of a package; said wrapped yarn coil being wound on a bobbin while being gripped by a slit-like groove formed on the bobbin end along a peripheral circle of the bobbin, and being followed by a transfer tail yarn; comprising the steps of:

severing the wrapped yarn coil to produce two severed ends at a position on the bobbin end in which the slit-like groove does not exist, holding one end of said two severed ends of the wrapped yarn coil by suction, gripping the one end with a gripper,and rotating the gripper to impart a twist to the yarn coil and displacing the gripper away from the bobbin, as the bobbin is rotated to unwind the yarn coil from the slit-like groove.

10. A method for removing a wrapped yarn coil as defined by claim 5 or 9, wherein the yarn severing position is determined by the following steps of while rotating the package by a motor having a rotational angle detecter, detecting levels of a groove or a recess formed at a predetermined position on the bobbin and a reference surface without the groove or the recess by first and second sensors, respectively, obtaining a difference between the levels detected by the two sensors, obtaining a position of the groove or recess by the rotational angle corresponding to the level difference, and determining a surface area of the bobbin end to be a yarn severing position based on the position of the groove or recess.

11. A method for removing a wrapped yarn coil as defined by claim 10, wherein the first and second sensors are distance sensors.

12. A method for removing a wrapped yarn coil as defined by claim 9, further comprising the steps of:

delivering a seal from a seal delivery means carried on a seal mat, receiving the seal by a seal suction pad, transporting the seal to a position at which the transfer tail yarn is in contact with a surface of the bobbin, and adhering the seal onto the bobbin end at said position, so that the transfer tail yarn is fixed on the bobbin.

13. A method for removing a wrapped yarn coil as defined by claim 9, wherein a yarn position on the bobbin end is detected from an image represented by binary values, comprising the steps of:

irradiating an ultraviolet ray onto the bobbin end so that a secondary excitation beam is irradiated from yarns wound on the bobbin end, receiving the secondary excitation beam by a photosensor, converting the secondary exciting beam to an image signal, obtaining a binary image signal from the image signal, determining a true value of a yarn position at which a yarn is fixed by a seal or a yarn severing position after correcting a yarn position measured by the binary image signal by adding a correcting value for correcting a detection error accompanied with the binary conversion; said correcting value being predetermined through a number of measurements in accordance with various yarn kinds and yarn thicknesses.

14. A method for removing a wrapped yarn coil as defined by claim 13, wherein the displacement of the yarn cutting means or the seal delivery means is controlled by an output signal of the true value.

15. A method for removing a wrapped yarn coil as defined by claim 13, wherein the yarn position corresponds to an innermost edge of a wrapped yarn coil farthest from the bobbin end surface.

16. A method for removing a wrapped yarn coil as defined by claim 15, wherein the yarn position is determined by Steps of:

detecting one of the detected wrapped yarn coils having a width larger than a predetermined value, based on the binary image signal, selecting one of the detected wrapped yarn coils farthest from the bobbin end surface, and determining a yarn position as an edge of the selected wrapped yarn coil farthest from the bobbin end surface.

17. A method for removing a wrapped yarn coil as defined by claim 15 or 16, wherein a yarn severing position is determined by adding a predetermined margin to a true value of the yarn position.

18. A method for removing a wrapped yarn coil as defined by claim 13, 14, 15 or 16, comprising steps of irradiating an ultraviolet ray onto the bobbin end so that a secondary excitation beam is irradiated from yarns wound on the bobbin end, receiving the secondary excitation beam by a photosensor to convert the same to an image signal, and obtaining a binary image signal from the image signal.

* * * * *